US005617923A

United States Patent [19]

Nishikubo et al.

[11] Patent Number: 5,617,923

[45] Date of Patent: Apr. 8, 1997

[54] MODULAR FIRE EXTINGUISHING APPARATUS FOR AN ENCLOSED ENVIRONMENT

[75] Inventors: John S. Nishikubo; Michael J. Potter, both of San Diego, Calif.

[73] Assignee: Nishikubo Family Trust, Los Angeles, Calif.; a part interest

[21] Appl. No.: 498,952

[22] Filed: Jul. 6, 1995

[51] Int. Cl.[6] ..... A62C 35/02

[52] U.S. Cl. ..... 169/51; 169/11; 169/26

[58] Field of Search ..... 169/51, 54, 11, 169/26, 65

[56] References Cited

U.S. PATENT DOCUMENTS

| | | | |
|---|---|---|---|
| 1,898,482 | 2/1933 | Doughty | 169/26 |
| 2,274,783 | 3/1942 | Geertz | 169/11 |
| 2,544,016 | 3/1951 | Getz | 169/11 |
| 2,630,867 | 3/1953 | Heigis | 169/11 |
| 3,064,740 | 11/1962 | Knapp | 169/26 |
| 3,486,562 | 12/1969 | Goodloe et al. | 169/11 |
| 3,497,012 | 2/1970 | Williamson | 169/1 |
| 3,824,374 | 7/1974 | Mayher | 169/65 |
| 4,109,726 | 8/1978 | Hansen et al. | 169/11 |
| 4,183,409 | 1/1980 | Iida | 169/11 |
| 4,256,181 | 3/1981 | Searcy | 169/65 |
| 4,356,870 | 11/1982 | Gaylord et al. | 169/65 |
| 4,527,635 | 7/1985 | Kirchner | 169/26 |
| 4,819,732 | 4/1989 | Laumeister | 169/61 |
| 4,895,208 | 1/1990 | Alasio | 169/26 |
| 5,123,490 | 6/1992 | Jenne | 169/26 |
| 5,197,548 | 3/1993 | Volker et al. | 169/11 |
| 5,287,702 | 2/1994 | Blackshaw et al. | 169/11 |

FOREIGN PATENT DOCUMENTS

| | | | |
|---|---|---|---|
| 2702664 | 9/1994 | France | 169/11 |

*Primary Examiner*—Gary C. Hoge
*Attorney, Agent, or Firm*—John R. Flanagan

[57] ABSTRACT

A modular fire extinguishing apparatus for an enclosed environment includes a housing adapted for attachment to a support structure, a canister storing a pressurized gaseous substance such as carbon dioxide for the extinguishment of fires and being mounted to the housing, a conduit connected at one end to the canister for piping the pressurized gaseous substance away therefrom, a nozzle for receiving and dispersing the pressurized gaseous substance, a coupler for connecting a second end of the conduit to the nozzle, and a heat sensor for detecting a preselected temperature in the enclosed environment and in response to such detection causing the release of the pressurized gaseous substance through the nozzle and dispersal thereof over the vicinity of the enclosed environment to extinguish a fire.

19 Claims, 1 Drawing Sheet

MODULAR FIRE EXTINGUISHING APPARATUS FOR AN ENCLOSED ENVIRONMENT

BACKGROUND OF THE INVENTION

1. Field of the Invention

The present invention generally relates to systems for the extinguishment of fires and, more particularly, is concerned with a modular fire extinguishing apparatus for an enclosed environment.

2. Description of the Prior Art

Fire extinguishing systems, such as water sprinkling systems, are used widely in many different enclosed environments such as homes or office buildings. Common features of these systems include the use of a storage container or source of a pressurized water connected to a discharge outlet in the area to be protected. Gases such as carbon dioxide are also used to a limited extent for this purpose. Carbon dioxide warms up quickly and does not wet any of the surfaces upon which it falls, thereby working without causing damage to furniture and other objects due to freezing or moisture.

Representative examples of fire extinguishing systems utilizing carbon dioxide and other gases are disclosed in U.S. Pat. Nos. 2,274,783 to Geertz, 2,544,016 to Getz, 2,630,867 to Heigis, 3,486,562 to Goodloe et al, 3,497,012 to Williamson, 4,109,726 to Hansen et al, 4,183,409 to Iida, 4,819,732 to Laumeister, 5,197,548 to Volker et al and 5,287,702 to Blackshaw et al.

A problem exists, however, in that these prior art systems appear to be complex and inflexible and do not seem to provide a simple comprehensive solution for the extinguishment of fires in an enclosed environment.

Consequently, a need still exists for a system which overcomes these aforementioned problems in the prior art without introducing new problems in their place.

SUMMARY OF THE INVENTION

The present invention provides a modular fire extinguishing apparatus for an enclosed environment which is designed to satisfy the aforementioned need by providing a simple comprehensive solution which is easily retrofitable, disposable and requires only one housing. The apparatus further adds flexibility in that it meets the individualized fire extinguishing needs of different enclosed environments as opposed to a centralized system provided to serve all the needs of a building.

Accordingly, the present invention is directed to a modular fire extinguishing apparatus flexibly designed to easily retrofit an enclosed environment. The apparatus comprises: (a) a housing being adapted for attachment to a support structure; (b) a canister for storing a gaseous substance under pressure for the extinguishment of fires and being mounted to the housing; (c) a conduit connected at one end to the canister for piping the gaseous substance under pressure away therefrom; (d) a nozzle for receiving and dispersing the gaseous substance; (e) coupling means for connecting a second end of the conduit to the nozzle; and (f) heat sensing means for detecting a preselected temperature in the enclosed environment and in response to such detection causing the release of the pressurized gaseous substance through the nozzle over the vicinity to extinguish a fire.

More particularly, the housing has a base adapted for attachment to the support structure and a cover adapted for attachment to the base. The cover further has an end wall with an opening therein and a pair of brackets mounted thereon inside of the housing. The canister has an outlet port and is mounted to the pair of brackets on the cover. The gaseous substance stored under pressure in the canister is preferably comprised substantially of carbon dioxide.

The conduit at a first open end is attached to the outlet port of the canister for piping the gaseous substance under pressure away therefrom. The conduit is preferably made substantially of a flexible material such as a flexible plastic tubing. The coupling means is a coupler disposed through the opening of the cover of the housing and attached at a first end disposed inside the housing to a second open end of the conduit. A second end of the coupler is disposed outside of the housing and mounts the nozzle. The heat sensing means is a body of metal attached to the nozzle and normally closing the nozzle. The heat sensing metal body is adapted to detect a preselected temperature in the enclosed environment by melting in response to the ambient temperature in the enclosed enviroment rising to the preselected temperature. Melting of the metal body opens the nozzle and allows release of the pressurized gaseous substance through the nozzle and its dispersal over the vicinity of the enclosed environment to extinguish a fire therein.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
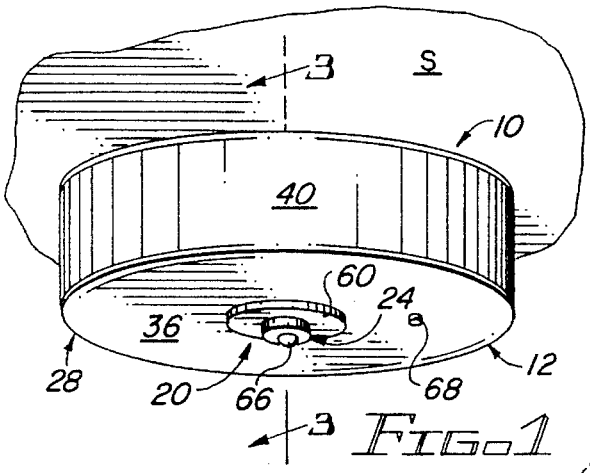
FIG. 1 is a perspective view of the modular fire extinguishing apparatus of the present invention mounted below a ceiling.
Figure 2:
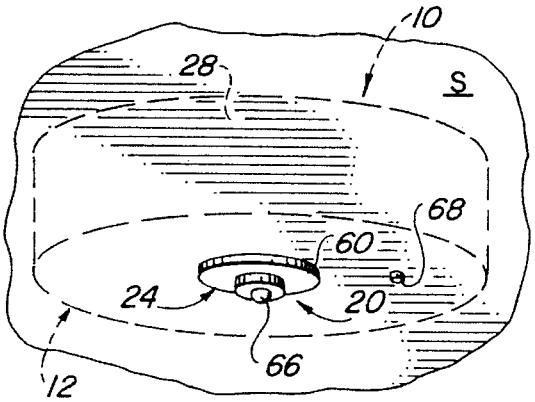
FIG. 2 is a perspective view of the modular fire extinguishing apparatus mounted above the ceiling.

Referring to the drawings and particularly to FIGS. 1 and 2, there is illustrated a modular fire extinguishing apparatus, being generally designated 10, of the present invention. The modular apparatus 10 is designed for use in an enclosed environment, such as a room of a building, a compartment of a vehicle and the like. The modular apparatus 10 may be mounted on and extend from a support structure S, such as a wall or ceiling, of the enclosed environment as shown in FIG. 1, or alternatively may be mounted above the support structure S as shown in FIG. 2.

Referring to FIGS. 1 through 4, the modular fire extinguishing apparatus 10 basically includes a housing 12 adapted for attachment to the support structure S, a canister 14 for storing a gaseous substance 16 under pressure for the extinguishment of fires and being mounted in the housing 12, and an elongated conduit 18 connected at a first end 18A to the canister 14 and being hollow for routing or piping the pressurized gaseous substance 16 away therefrom. Further, the modular apparatus 10 basically includes a nozzle 20 for receiving and dispersing the pressurized gaseous substance 16, a coupling means 22 for connecting a second end 18B of the conduit 18 to the nozzle 20, and a heat sensing means 24 for detecting a preselected temperature in the enclosed environment and in response to such detection causing the release of the pressurized gaseous substance 16 through the nozzle 20 and over the vicinity of the enclosed environment to extinguish a fire.

Figure 3:
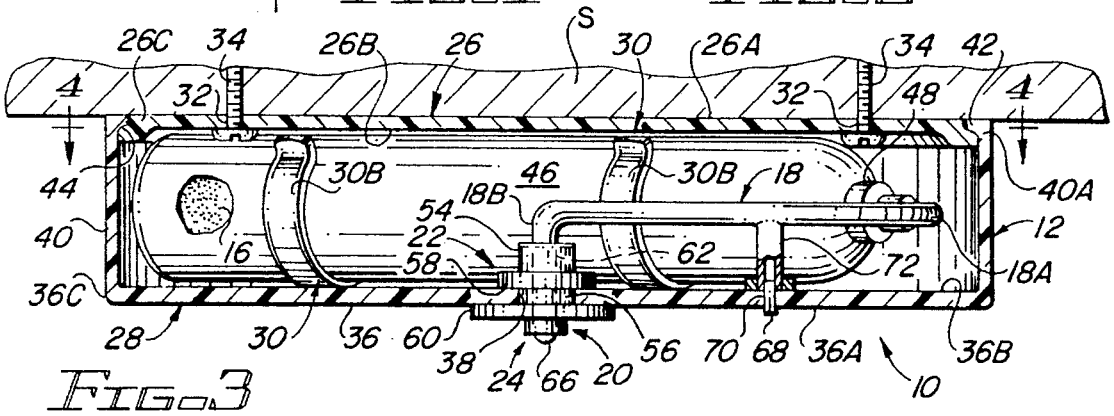
FIG. 3 is an enlarged partially sectional view of the modular fire extinguishing apparatus taken along line 3—3 of FIG. 1.
Figure 4:
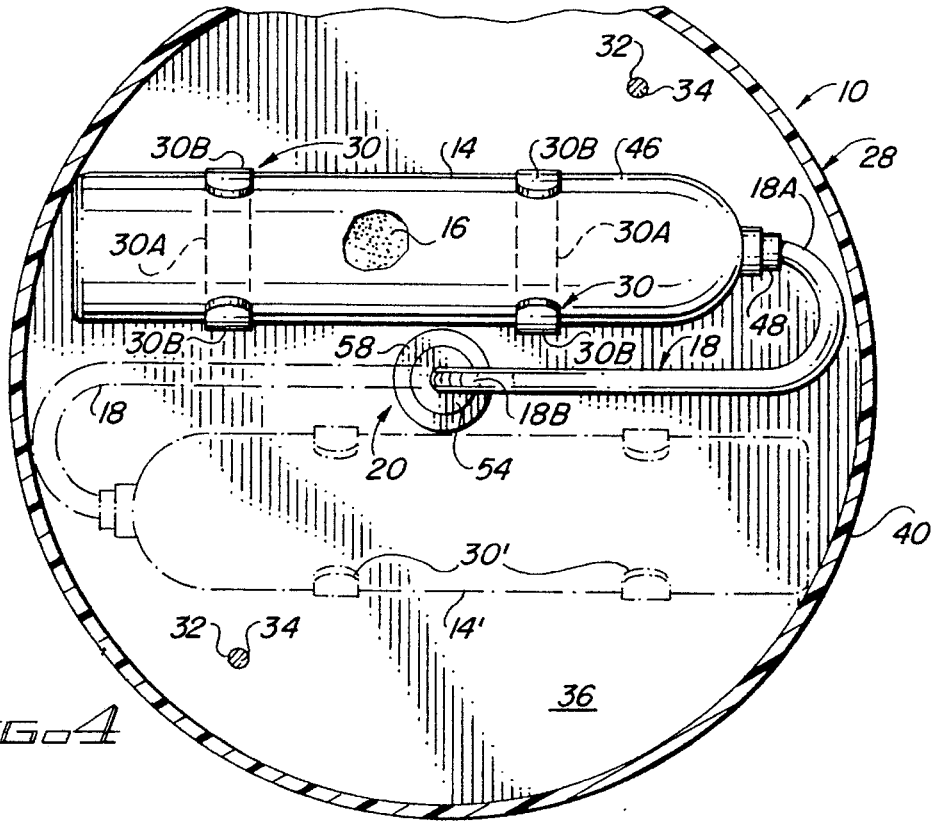
FIG. 4 is an enlarged top view of the modular fire extinguishing apparatus taken along line 4—4 of FIG. 3.

Referring now particularly to FIGS. 3 and 4, the housing 12 of the modular apparatus 10 has a base 26 adapted for attachment to the support structure S, a cover 28 removably attached to the base 26, and at least one and preferably a pair of brackets 30 mounted to the cover 28. In one exemplary embodment of the housing 12, the base 26 is substantially flat and circular in shape and has an exterior surface 26A, an interior surface 26B and a perimeter edge 26C. The base 26 also has a pair of mounting holes 32 therein located diagonally opposite from one another. The mounting holes 32 are located relatively closer to the perimeter edge 26C of the base 26 than to the center thereof and are provided therein to facilitate the passage of fasteners 34, such as screws, for the attachment of the base 26 to the support structure S, as depicted in FIG. 3. The housing 12 may be so mounted by its base 26 below the support structure S, such as a ceiling as shown in FIG. 1, or above the support structure S, such as the ceiling as shown in FIG. 2.

Also, in the same exemplary embodiment of the housing 12, the cover 28 is substantially cylindrical in shape and includes an end wall 36 with an exterior surface 36A, an interior surface 36B, a perimeter edge 36C and an opening 38, for instance, being defined centrally through the end wall 36. The cover 28 also includes a continuous sidewall 40 integrally attached to and extending outwardly from the interior surface 36B of the end wall 36 at the perimeter edge 36C thereof and having a circular outer terminal edge 40A for attachment to the perimeter edge 36C of the base 26. Cooperating attachment elements 42, 44 are defined respectively on the perimeter edge 26C of the base 26 and on the outer terminal edge 40A of the sidewall 40 of the cover 28 for removably attaching the cover 28 on the base 26. For example, the attachment elements 42, 44 can be matable threaded surfaces, as shown in FIG. 3, which by selected rotation of the cover 28 in one or the other of opposite directions relative to the stationarily-mounted base 26 permits the quick and easy attachment of the cover 28 to or removal of the cover 28 from the base 26.

Further, in the same exemplary embodiment of the housing 12, the pair of brackets 30 are mounted to the end wall 36 of the cover 28 and extend outwardly from the interior surface 36B thereof. Each of the brackets 30 is substantially U-shaped having a flat base portion 30A and a pair of spaced apart flexible curved arm portions 30B being integrally connected to opposite ends of the base portion 30A resiliently expandable for receiving and releasing the canister 14 therebetween.

Referring still to FIGS. 3 and 4, the canister 14 of the modular apparatus 10 has an elongated body 46, preferably cylindrical is shape and adapted to hold gaseous substances therein under pressure, with an outlet port 48 defined at one end of the body 46. The canister 14 is disposed along and adjacent to the interior surface 36B of the cover end wall 36 by being mounted to the pair of brackets 30 on the cover end wall 36 between the respective pairs of arm portions 30B of the brackets 30. The cylindrical configuration of the canister 14 adapts it to fit snugly between the curved arm portions 30B of the brackets 30. The housing 12 may alternatively have a second pair of brackets 30' mounted thereto in substantially parallel relation to the first pair of brackets 30 on the interior surface 36B of the cover end wall 36 for retaining thereon a second canister 14' so as to increase the overall capacity of the pressurized gaseous substance stored in the modular apparatus 10, as shown in phantom in FIG. 4. The gaseous substance 16 stored under pressure in the canister 14 is preferably comprised substantially of carbon dioxide, although it may alternatively be comprised of any other suitable gas capable of extinguishing a fire, such halon.

The elongated conduit 18 of the modular apparatus 10 is preferably a relatively short length of flexible hollow tubing made of any suitable known material, such as a plastic material. As mentioned above, the flexible conduit 18 has a pair of first and second opposite open ends 18A, 18B. The first end 18A of the conduit 18 is attached to the outlet port 48 of the canister 14 for routing or piping the pressurized gaseous substance 16 away from the outlet port 48 of the canister 14. The second end 18B of the conduit 18 is attached to the coupling means 22 described below.

Referring to FIGS. 1 to 3, the nozzle 20 and coupling means 22 of the modular apparatus 10 can take any suitable form. In one example, the coupling means 22 of the modular apparatus 10 is preferably a tubular coupler 22 disposed through the central opening 38 of the cover 28. The coupler 22 has a pair of opposite open ends 54, 56. A first end 54 of the pair of opposite ends of the coupler 22 receives the second end 18B of the conduit 18 and extends outwardly from the interior surface 36B of the end wall 36 of the cover 28. A second end 56 of the pair of opposite ends of the coupler 22 extends outwardly from the exterior surface 36A of the end wall 36 of the cover 28 and connects to the nozzle 20. The nozzle 20 attaches in any suitable manner, such as by threading, onto the second end 56 of the coupler 22 and the nozzle 20 and coupler 22 together are thereby mounted to the end wall 36 of the cover 28 by an annular flange 58 on the first end 54 of the coupler 22 being disposed in abutting relationship with the interior surface 36B of the cover end wall 36 and an annular flange 60 on the nozzle 20 being disposed in abutting relationship with the exterior surface 36A of the cover end wall 36. The coupler 22 has a central bore 62 formed therethrough providing communication of flow of the pressurized gaseous substance 16 from the conduit 18 to the nozzle 20 where the gaseous substance 16 is released through the nozzle 20, causing its dispersal in the enclosed environment.

As mentioned above, the heat sensing means 22 of the modular apparatus 10 is provided to detect a preselected temperature in the enclosed environment and causes the nozzle 20 to open in response to such detection and thereby release the pressurized gaseous substance 16 from the nozzle 20 past the deflector 64 thereon and in the vicinity of the enclosed environment in order to extinguish a fire. The heat sensing means 22 is preferably a heat sensitive element 22, such as a metal body, on the nozzle 18 adapted to cover the nozzle 20 so as to normally block the flow of the pressurized gaseous substance 16 in the canister 14 from the nozzle 20 when the ambient temperature of the enclosed environment is below a preselected level and further adapted to melt so as to unblock the flow of the gaseous substance 16 when the ambient temperature of the enclosed environment rises above the preselected level. The metal body comprising the heat sensitive element 66 is a known metal, such as a solder, that will melt away at a predetermined temperature below the combustion temperature of the enclosed environment.

Also, preferably, a pressure button 68 is mounted to the cover 22 through an aperture 70 therein and connected by a tube 72 to the conduit 18. By pressing momentarily inward on the button 68, a small amount of the gaseous material 16 will be released indicating that the canister 14 is pressurized. Other known devices can be employed to monitor the pressure level in the canister.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A modular fire extinguishing apparatus for an enclosed environment, said apparatus comprising:

(a) a housing having an interior surface, said housing being adapted for attachment to a support structure;

(b) a canister having an outlet port and being adapted for storing a pressurized gaseous substance for the extinguishment of fires, said canister being mounted to said interior surface of said housing;

(c) a conduit having a pair of opposite open ends, a first of said open ends being attached to said outlet port of said canister for piping the pressurized gaseous substance away therefrom;

(d) a nozzle for receiving and dispersing the pressurized gaseous substance;

(e) means mounted to said housing for coupling a second of said open ends of said conduit to said nozzle; and (f) means for sensing a preselected temperature in the enclosed environment and causing said nozzle to open in response to detecting the preselected temperature and thereby to release a flow of said pressurized gaseous substance through said nozzle and disperse said pressurized gaseous substance from said nozzle over the vicinity of the enclosed environment to extinguish a fire.

2. The apparatus of claim 1 further comprising:

a pressurized gaseous substance stored in said canister being comprised substantially of carbon dioxide.

3. The apparatus of claim 1 wherein said conduit is made substantially of a flexible material.

4. The apparatus of claim 1 wherein said heat sensitive element is comprised substantially of a metal which melts at said preselected temperature which is a predetermined temperature below the combustion temperature of the enclosed environment.

5. A modular fire extinguishing apparatus for an enclosed environment, said apparatus comprising:

(a) a housing including (i) a base for attachment to a support structure, (ii) a cover having an interior surface, an exterior surface, and an opening defined through said cover, said cover being adapted for attachment to said base, and (iii) at least one bracket mounted to said interior surface of said cover;

(b) a canister having an outlet port and storing a pressurized gaseous substance for the extinguishment of fires, said canister being mounted to said bracket on said interior surface of said cover;

(c) a conduit having a pair of opposite open ends, a first of said open ends attached to said outlet port of said canister for piping said pressurized gaseous substance away therefrom;

(d) a coupler disposed through said opening of said cover of said housing and having a pair of opposite open ends, a first of said open ends of said coupler for receiving a second of said open ends of said conduit and extending below said interior surface of said cover and a second of said open ends of said coupler extending above said exterior surface of said cover;

(e) a nozzle for receiving and dispersing said pressurized gaseous substance, said nozzle being mounted to said second open end of said coupler so as to provide flow communication between said nozzle and said second open end of said conduit; and (f) means for sensing a preselected temperature in the enclosed environment and causing said nozzle to open in response to detecting the preselected temperature and thereby to release a flow of said pressurized gaseous substance through said nozzle and disperse said pressurized gaseous substance from said nozzle over the vicinity of the enclosed environment to extinguish a fire.

6. The apparatus of claim 5 wherein said pressurized gaseous substance stored in said canister is comprised substantially of carbon dioxide.

7. The apparatus of claim 5 wherein said canister is substantially cylindrical in shape.

8. The apparatus of claim 5 wherein said bracket mounted to said cover is substantially U-shaped having a base portion and a pair of flexible arm portions interconnected to said base portion of said bracket for receiving and releasing said canister.

9. The apparatus of claim 5 wherein said base of said housing has a perimeter edge and a pair of holes opposite one another, each of said holes being located closer to said perimeter edge than to the center of said base and adapted for the passage of a fastener for attachment of said base to the support structure.

10. The apparatus of claim 5 wherein said conduit is made substantially of a flexible material.

11. A modular fire extinguishing apparatus for an enclosed environment, said apparatus comprising:

(a) a housing including (i) a base having a perimeter edge, said base being adapted for attachment to a support structure, (ii) a cover having an end wall with an interior surface, an exterior surface, a perimeter edge and an opening defined through said end wall, said cover also having a sidewall attached to and extending outwardly from said interior surface of said end wall at said perimeter thereof and being adapted for attachment to said perimeter edge of said base, and (iii) a pair of brackets mounted on said interior surface of said cover;

(b) a canister having an outlet port and storing a pressurized gaseous substance for the extinguishment of fires, said canister being mounted to said pair of brackets on said interior surface of said cover;

(c) a flexible tubing having a pair of opposite open ends, a first of said open ends being attached to said outlet port of said canister for piping said pressurized gaseous substance away therefrom;

(d) a coupler disposed through said opening of said cover and having a pair of opposite open ends, a first of said open ends of said coupler for receiving a second of said open ends of said tubing and extending below said interior surface of said cover and a second of said open ends of said coupler extending above said exterior surface of said cover;

(e) a nozzle for receiving and dispersing said pressurized gaseous substance, said nozzle being mounted to said second open end of said coupler so as to provide communication between said nozzle and said second open end of said conduit; and (f) a heat sensitive element on said nozzle being adapted to cover said nozzle so as to normally block the flow of said pressurized gaseous substance from said canister when the ambient temperature of the enclosed environment is below a preselected temperature, said heat sensitive element further being adapted to melt so as to unblock the flow of said pressurized gaseous substance from said nozzle when the ambient temperature of the enclosed environment rises above the preselected temperature, thereby causing said nozzle to disperse said pressurized gaseous substance over the vicinity of the enclosed environment to extinguish a fire.

12. The apparatus of claim 11 wherein said opening is centrally located in said end wall of said cover.

13. The apparatus of claim 11 wherein said heat sensitive element is comprised substantially of a metal which melts at said preselected temperature which is below a predetermined combustion temperature of the enclosed environment.

14. The apparatus of claim 11 wherein said pressurized gaseous substance stored in said canister is comprised substantially of carbon dioxide.

15. The apparatus of claim 11 wherein said base is substantially circular in shape.

16. The apparatus of claim 11 wherein said cover is substantially cylindrical in shape.

17. The apparatus of claim 11 wherein said canister is substantially cylindrical in shape.

18. The apparatus of claim 11 wherein each of said brackets mounted to said cover is substantially U-shaped having a base portion and a pair of flexible arm portions interconnected to said base portion for receiving and releasing said canister.

19. The apparatus of claim 11 wherein said base further has a pair of holes opposite one another, each of said holes being located closer to said perimeter edge than to the center of said base and being for the passage of a fastener for attachment to the support structure.

* * * * *